United States Patent [19]

Kondo et al.

[11] 4,370,634

[45] Jan. 25, 1983

[54] CIRCUIT BREAKER

[75] Inventors: Hideya Kondo; Youichi Yokoyama; Youichi Aoyama; Tamotsu Mori, all of Osaka, Japan

[73] Assignee: Matsushita Electric Works, Ltd., Osaka, Japan

[21] Appl. No.: 263,487

[22] Filed: May 14, 1981

[30] Foreign Application Priority Data

May 20, 1980 [JP] Japan ..... 55-67306

[51] Int. Cl.[3] ..... H01H 75/00; H01H 77/00; H01H 83/00

[52] U.S. Cl. ..... 335/16; 335/201

[58] Field of Search ..... 335/201, 16

[56] References Cited

U.S. PATENT DOCUMENTS 4,325,041 4/1982 Murai ..... 335/201

*Primary Examiner*—Harold Broome

*Attorney, Agent, or Firm*—Burns, Doane, Swecker & Mathis

[57] ABSTRACT

A circuit breaker having an arc suppressing means disposed adjacent a contactor section and including a first arc running plate extended from a fixed contactor and a second arc running plate opposed to the first arc running plate. The distance between the both arc running plates on the side close to the contactor section is minimized so as not to cause any spatial short-circuiting to occur. At portions of the both arc running plates defining the minimized distance, magnetic arc driving force motivated by mutually oppositely directed arc currents flowing through the respective arc running plates is increased to a large extent, whereby arc shifting to deion grid of the arc suppressing means can be performed effectively quickly.

5 Claims, 10 Drawing Figures

CIRCUIT BREAKER

This invention relates generally to circuit breakers capable of breaking power supply circuit to an associated load responsive either to a short-circuit current or a continuously existing excess current beyond the rated current of the load and, more specifically, to a circuit breaker including means for highly efficiently dividing, cooling and suppressing an arc occurring upon separations of movable contact from fixed contact at the time of breaking the circuit.

The circuit breaker of the kind referred to generally comprises a plurality of breaker units corresponding in number to poles of either single-phase or three-phase alternating current source, and the breaker units comprise respectively a fixed contactor having a fixed contact, a movable contactor having a movable contact which is normally engageable with the fixed contact responsive to operations of a manual contact opening and closing mechanism, an arc suppressing means disposed in the vicinity of opening and closing positions of the movable contact with respect to the fixed contact, and a tripping means operably coupled to the movable contactor for forcibly separating the same from the fixed contactor in response to the short-circuiting or excess current. Normally, the contacts are opened by separating the movable contactor from the fixed contactor with an actuation of the manual contact opening and closing mechanism. On the other hand, when a short-circuit occurs or an excess current beyond the rated current of the load current continuously flows through the circuit, the tripping means is caused to operate so as to separate the movable contactor from the fixed contactor and open the both contacts in the same manner as the manual contact opening operation. The arc generated upon the opening of the contacts is driven toward the arc suppressing means to be thereby divided, cooled and suppressed.

More specifically, when the tripping means operates to open the contacts, the excess current will flow across the contacts for a time period which corresponds substantially to one half cycle of the A.C. current, as illustrated with a curve SCC of chain-line in FIG. 1A. At this time, the arc is normally generated as slightly delayed after initial rising of the excess current SCC, gradually increased to reach its maximum immediately before the excess current becomes zero, and is rapidly attenuated, as shown by a curve NVa of chain-line in FIG. 1B. That is, the arc is caused to continuously occur while it gradually expand between the contacts being separated from each other, so that the arc will give unfavorable influences on respective elements associated with the contacts.

Now, as the arc suppressing means comprising a well known deion grid is provided, the arc is caused to expand toward the entire one end area of the arc suppressing means in a relatively short time and to maintain its maximum value for a relatively longer time period as compared with the normal arc curve NVa in the case having no arc suppressing means, thereafter the arc disappears in a considerably shorter time as compared with the arc curve NVa, depending on a period in which such access current as shown by a curve LSCC1 of dotted line in FIG. 1A occurs and disappears. In other words, it will be understood to those skilled in the art that the arc suppressing means causes the arc voltage to reach its maximum level at the time when the excess current reaches its maximum level and the excess current to reach zero much sooner than in the case of having no arc suppressing means to have the arc disappeared sooner. As will be seen from FIG. 1A, in the absence of the arc suppressing means, the excess current such as a short-circuit current will normally reach its maximum in about 4 m.sec. and drop to zero in about 10 m.sec., whereas in the presence of the arc suppressing means the excess current will reach its maximum in about 1.5 m.sec. and drop to zero in about 6 m.sec.

If an excess current of such a short-circuit current as illustrated with a solid line curve LSCC2 in FIG. 1A is made to reach its maximum level faster by, for example, 0.5 m.sec. than the curve LSCC1, then the excess current of the curve LSCC2 will drop to zero in about 5 m.sec., whereby the time required for the arc voltage to reach the maximum level and for the arc to disappear can be made shorter. In the case where the arc suppressing means has a fixed arc suppressing ability, the above time reduction will depend upon how fast the arc is shifted away from the contacts, how fast the arc is expanded to the arc suppressing means and how fast the arc is driven into the means.

Accordingly, a primary object of the present invention is to provide a circuit breaker which allows the arc generated at the time of the contact opening due to such excess current as a short-circuit current to extremely quickly shift to the arc suppressing means by means of an increased electromagnetic repulsion.

Another object of the present invention is to provide a circuit breaker in which the pressure of gas produced upon the arc generation keeps its balanced state at the contact section and arc suppressing means.

A further object of the present invention is to provide a circuit breaker wherein an arc running plate forming a part of the fixed contactor or the arc suppressing means is prevented from being floated by the high pressure arc gas and thereby the arc shifting toward the arc suppressing means can be made smoothly.

Other objects and advantages of the present invention shall become clear as the following descriptions of the invention advance in detail with reference to preferred embodiments of the invention shown in accompanying drawings, in which.

Figure 1A:
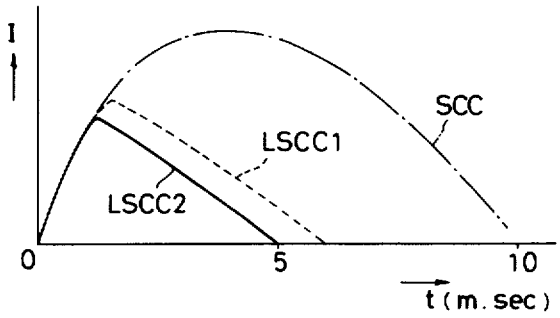
FIG. 1A is a waveform diagram of respective excess currents caused when the contacts of circuit breakers with and without the arc suppressing means are opened.

While the present invention shall now be referred to with reference to the preferred embodiments shown in the drawings, the intention is not to limit the invention only to those embodiments but to rather include all modifications, alterations and equivalent arrangements possible within the scope of appended claims.

Figure 5:
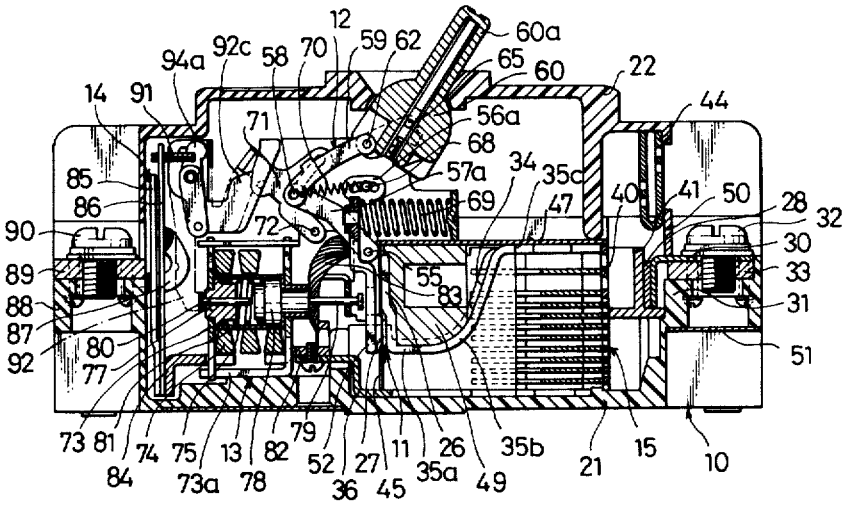
FIG. 5 is a cross sectional view of the circuit breaker of FIG. 2 taken along line V—V in FIG. 2, with the cover member mounted.
Figure 6:
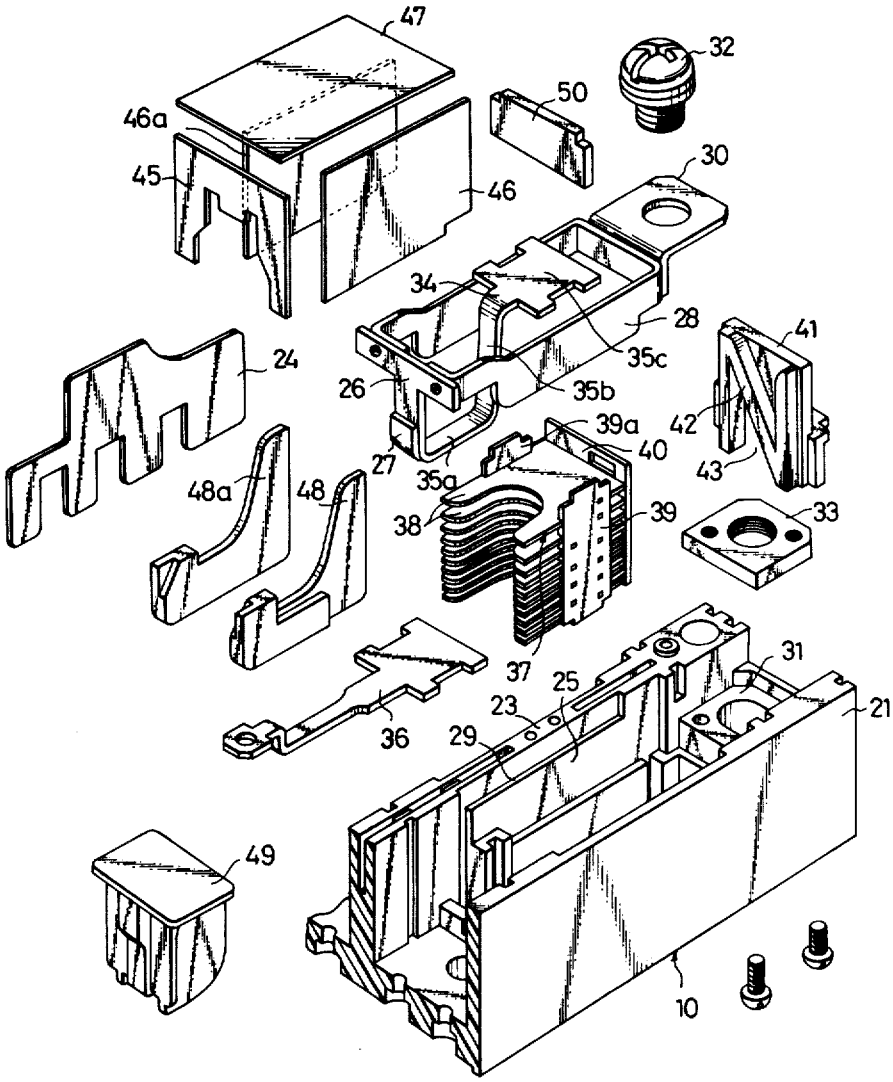
FIG. 6 is a perspective view of an arc suppressing means used in the circuit breaker in accordance with the present invention, showing their component parts as disassembled.
Figure 7:
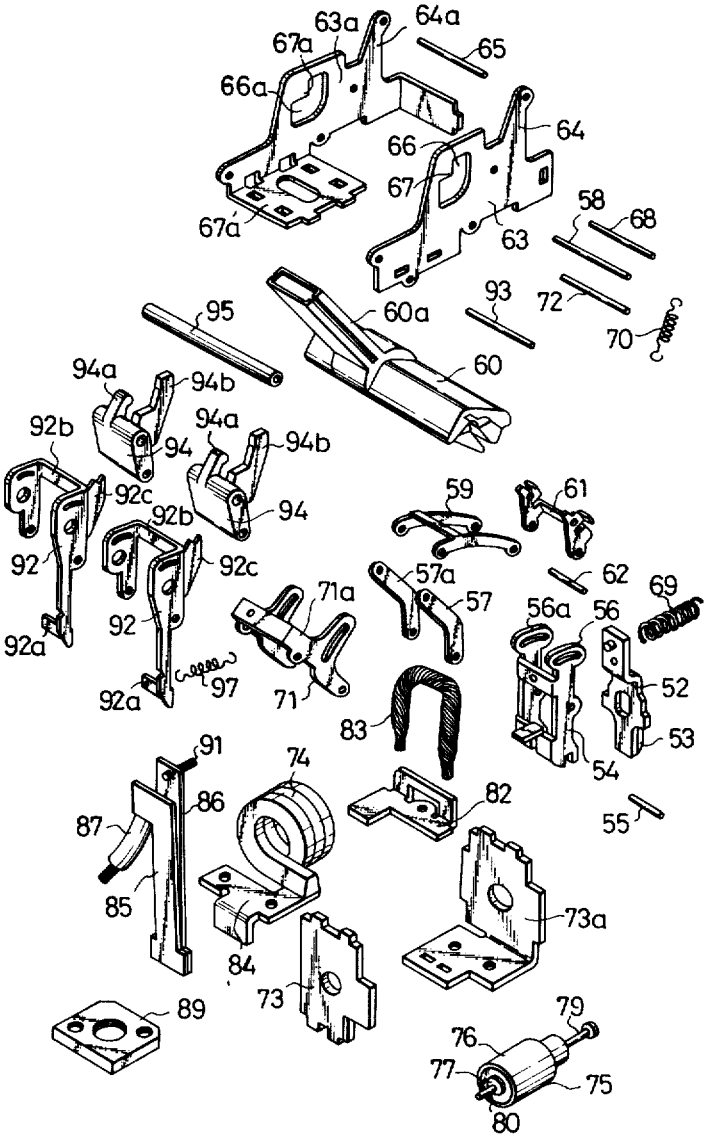
FIG. 7 is a perspective view of a contact section, manual contact opening and closing mechanism and forcibly tripping means used in the circuit breaker of FIG. 2, in which most of their component parts are shown as disassembled.

Referring now, in particular, to FIG. 5, there is shown a circuit breaker according to an embodiment of the present invention, which comprises generally a contact section 11 disposed substantially in the center of a housing 10, a manual contact opening and closing mechanism 12 which can open and close the contact section from the exterior of the housing 10, an electromagnetically tripping means responsive to a short-circuit current to open the contact section, a heat-sensitive tripping means 14 responsive to an excess current beyond the rated current to also open the contact section, and arc suppressing means 15 which electromagnetically attracts, divides, cools and suppresses the arc generated at the time of opening the contacts in the contact section.

More specifically, the housing 10 comprises a hollow base 21 and hollow cover member 22 with which the base 21 is covered on its open side. Within the housing 10 are defined unit receiving chambers 25 by partition walls 23 provided as erected and partioning plates 24 which are inserted respectively in a groove made in each partition wall 23. Substantially in the center of each unit receiving chamber 25 a substantially T-shaped fixed contactor 26 which forming a part of the contact section is disposed. A fixed contact 27 is rigidly secured to the lower portion of the fixed contactor 26 which is secured with screws onto a free end of a linkage frame 28 of U-shape configuration as viewed from the top. This linkage frame 28 is seated in turn on a shoulder 29 formed on the base 21. To the base portion of the linkage frame 28, a metal fitting 30 as a power source side terminal which is mounted on a base portion 31 extending from one end of the unit receiving chamber 25 of the power source side terminal, and the metal fitting 30 is firmly secured to the base 21 by means of a terminal screw 32 and nut 33.

On the other hand, a first arc running plate 34 is provided to extend integrally from the lower end portion of the fixed contactor 26, and this arc running plate 34 comprises a lower portion **35*a* extending longitudinally toward the base portion of the linkage frame 28, an intermediate portion 35*b* extending diagonally upward so as to describe an arc toward the base portion of the linkage frame and an upper portion 35*c* extending horizontally over the linkage frame 28 in a slightly spaced relation to the frame. Further, a second arc running plate 36 is provided as secured onto the bottom surface of the base 21 beneath the contact section so as to extend from a position beneath the contact section 11 to a position beneath the upper portion 35*c* of the first arc running plate 34. Therefore, the first and second arc running plates 34 and 36 mutually define a first parallelly opposing part with a relatively smaller space and a second parallelly opposing part with a relatively larger space, and a deion grid assembly 37 is arranged within the larger space between the second opposing parts of these running plates. The assembly 37 comprises a plurality of grids 38 arranged parallel to one another as held between a pair of insulative side plates 39 and 39*a*, and the intermediate portion 35 of the first arc running plate 34 is partly positioned within aligned arcuate notches of the respective grids 38**.

The deion grid assembly 37 is provided on the side of the power source side terminal with a back plate 40 having many holes for discharging the arc gas therethrough and, between the back plate 40 and the base portion 31 carrying the power source side terminal 30, a screen 41 provided at its surface with an N-shaped protrusion 42 is interposed so as to engage with one surface of the back plate 40 of the grid assembly. The screen 41 is also provided with a gas discharging window 43 which opens downward and is cut into a triangle shape, so that the arc gas will flow upward through the holes in the back plate 40 and the gas discharging window 43 which occupies a relatively small area on the screen 41, along the inner walls of the base 21, and further to the exterior through gas discharging holes made in a small V-shaped discharge plate 44 secured to the inner surface of the cover member 22. In addition, the deion grid assembly 37 of the arc suppressing means 15 is surrounded by a front insulative plate 45 disposed on a side surface of the fixed contactor 26 in the contact section 11, insulative side plates 46 and **46*a* arranged between the both side walls of the linkage frame 28 and a top plate 47 opposed closely and over the top surface of the first arc running plate 34, so as to provide a proper isolation of the arc suppressing means 15 from the exterior. Furthermore, the arc suppressing means 15 includes a pair of supporting plates 48 and 48*a* disposed on the both sides of the first arc running plate 34 and respectively having an arcuate side edge of the same curvature as the intermediate portion 35*b* of the first arc running plate 34, and these plates 48 and 48*a* extend partially into gaps between the notches of the deion grid assembly 37 so as to define gas flowing paths 48' and 48*a*' together with the insulative side plates 46 and 46*a*. Between the supporting plates 48 and 48*a*, a pressing plate 49 having a lower surface made to be engageable with the lower portion 35*a* and intermediate portion 35*b* of the first arc running plate 34 is disposed so that the arc running plate 34 will be prevented from being caused to float by the arc gas. On the other hand, an end plate 50 is provided at an end on the side of the power source side terminal of the unit receiving chamber 25 so as to close a gap formed between the gas discharge plate 44 and the power source side terminal 30. A screen plate 51 is provided to the bottom surface of the base portion 31 of the terminal 30** so as to avoid any unfavorable influence on the terminal by the gas flowing therearound.

The contact section 11 disposed substantially in the center of the unit receiving chamber 25 includes a movable contactor 52 forming the other member of the section and having a movable contact 53 which contacts with and separates from the fixed contact 27 of the fixed contactor 26. Further, the movable contactor 52 is secured to a contactor frame 54 of a magnetic material, at least a part of which has the same length as the movable contactor, and they are joined by means of couplings of their extrusions into complementary holes and their lugs onto receiving notches. The frame 54 is U-shaped as viewed from the top and opened on the side of receiving the movable contactor 52, and the frame 54 is provided with a pivot shaft 55 passed through the frame substantially in the middle thereof and with arcuate ends 56 and 56*a* respectively including an arcuate hole and formed at both top ends, for being coupled to the manual contact opening and closing mechanism 12. Thus, first link arms 57 and 57*a* of the mechanism 12 are coupled at their one end to respective ends of the pivot shaft 55 from both sides of the frame 54 and at the other end through another pivot shaft 58 to one end of both side leg parts of an H-shaped second link arm 59, while the other ends of the both leg parts of the second link arm 59 are coupled through a supporting shaft 62 to one end of a handle link 61 which fits in a handle 60. An arm portion 60*a* is formed on the handle 60 so as to extend out of the cover member 3.

Further, the other end of the handle link 61 fitted to the handle 60 is pivoted through a pivot shaft 65 to lug portions 64 and 64*a* of a pair of supporting frames 63 and 63*a* which hold the manual contact opening and closing mechanism 12 on its both sides. The supporting frames 63 and 63*a* are provided with windows 66 and 66*a* which are respectively aligned horizontally with each other, and the pivot shaft 58 for the first and second link arms is loosely fitted in these windows 66 and 66*a* so that diagonal downward displacement of the first and second link arms will be normally restricted by projections 67 and 67*a* made in the windows 66 and 66*a*. The supporting frames 63 and 63*a* bear both ends of a shaft 68 passed freely shiftably through the arcuate holes in the arcuate ends 56 and 56*a* of the contactor frame 54 and a strong compression spring 69 is loaded between the upper portion of the movable contactor 52 and an end face of the supporting frame. In addition, a reversing spring 70 is hung between the pivot shaft 58 and the shiftable shaft 68, while the shaft 58 is freely shiftably inserted in arcuate slots made in a latch link 71, and base end of this latch link 71 is provided through a supporting shaft 72 between the supporting frames 63 and 63*a*.

One of the supporting frames which is 63*a* in the present case has a horizontal mounting yoke portion 67*a*' to which a pair of yoke plates 73 and 73*a* are mounted to form as joined a U-shaped configuration forming a part of the electromagnetic tripping means 13. Between the yoke plates 73 and 73*a* is arranged a plunger unit 75 which in turn is inserted in a coil 74, an insulative cylinder 76 of the plunger unit 75 secures at an end surface of the cylinder a stationary iron core 77 which is fitted into a hole formed in one of the yoke plates 73, while the cylinder 76 is fitted at a small diameter portion in a hole made in the other yoke plate 73*a*. The cylinder 76 contains a plunger 78 for reciprocating motion therein and a driving rod 79 is rigidly secured to the plunger, and a free end of the driving rod 79 is engaged in a slot made in the movable contactor frame 54. Further, an operating rod 80 is reciprocally held as passed through the stationary iron core 77 so as to be extruded out of the cylinder 76 by a motion of the plunger 78 against the action of a return spring 81 disposed within the cylinder. Further, an end of the coil 74 is joined to an intermediate terminal 82 which is fastened by means of a screw to an end portion of the side of the contact section 11 of the second arc running plate 36. A woven wire conductor 83 is connected to the intermediate terminal 82 which is connected at the other end to the movable contactor 52. The other end of the coil 74 is connected to another intermediate terminal 84.

The other end of the intermediate terminal 84 is connected to the bottom portions of a heater plate 85 and bimetal 86 both of which form the heat-sensitive tripping means 14. A woven wire cable 87 connects the heater plate 85 to a load side terminal 89 which is fastened onto a base portion 88 of the other end of the unit receiving chamber 25 by means of a terminal screw 90. When the heater plate 85 is heated with such arrangement as above, the bimetal 86 is caused to bend on the side of the manual contact opening and closing mechanism 12. To a tip portion of the bimetal 86 is screwed an adjustable pushing piece 91.

A tripping link 92 is pivotably connected at its middle portion to the other ends of the supporting frames 63 and 63*c* on the side of the load side terminal with a pivot shaft 93, and this tripping link 92 is provided with a lower driven portion 92*a* which is engageable with the operating rod 80 of the plunger unit 75 and with an upper driven portion 92*b* which is engageable with the pushing piece 91 of the bimetal 86. The tripping link 92 is made in a U-shape as viewed from the top so that a test-tripping piece 94 can be pivoted at its lower end between both legs of the U-shape by means of a pivot shaft 93. The tripping link 92 has also an extruded portion 92*c* which engages with a bridge portion 71*a* of the latch link 71. The tripping link 92 and test tripping piece 94 in each circuit breaker unit are interconnected to each other by a single coupling rod 95 penetrating through them. The rod 95 comprises an iron core and a plastic tube covering the core so as to be provided with a resiliency for absorbing any positional error between the tripping link 92 and test tripping piece 94 in each breaker unit. The test tripping piece 94 itself has a pressing portion 94*a* which normally engages with the upper driven portion 92*b* of the tripping link 92 and a driven arm portion 94*b* which is projected in the same direction as the engaging portion 92*c* and subjected to an external force given through a test push-button 96 mounted on the cover member. A return spring 97 is hung between the tripping link 92 and the supporting frame 63 to provide a return force to the tripping link 92.

Now, the general operation of the circuit breaker according to the present invention shall be briefly explained. FIG. 5 shows a state in which the handle 60 is in a position rotated clockwise in the drawing, upon which rotation the pivot shaft 58 of the first and second link arms 57, 57*a* and 59 will move downward along the arcuate slots in the latch link 71 in such manner that the contactor frame 54 and movable contactor 52 will move toward the fixed contactor 26 to thereby engage the movable contact 53 with the fixed contact 27 to form achieve their closed position.

On the other hand, a counterclockwise rotation of the handle 60 from a position of FIG. 5 will cause the pivot shaft 58 of the first and second link arms 57, 57*a* and 59 to move upward along the arcuate slot of the latch link 71 and thereby the contactor frame 54 and movable contactor 52 are drawn reversely to open the contacts.

If a short-circuit current flows through a conduction circuit of the power source side terminal 30, linkage frame 28, fixed contactor 26, fixed contact 27, movable contact 53, movable contactor 52, conductor 83, intermediate terminal 82, coil 74, intermediate terminal 84, bimetal 86, heater plate 85, conductor 87 and load side terminal 89, then magnetic excitation induced in the coil 74 by the current will attract the plunger 78 onto the stationary iron core 77 of the plunger unit 75, whereby the operating rod 80 is caused to extrude out of the plunger unit 75 to push the lower driven portion 92*a* of the tripping link 92 toward the load terminal side. This will allow the upper portion of the tripping link 92 to rotate clockwise about the pivot shaft 93 so that the engagement portion 92*c* will be disengaged from the latch link 71 which is coupled to the pivot shaft 58 of the first and second link arms 57, 57*a* and 59, whereby the manual contact opening and closing mechanism 12 is turned into a tripped state wherein the compression spring 69 urges the movable contactor 52 to be separated from the fixed contactor 26 to quickly open the contacts.

Further, when an excess current over the rated current continues to flow through the conduction circuit between the load side terminal 89 and the power source side terminal 30, the heater plate 85 is thereby caused to generate heat and the bimetal 86 is eventually caused to bend toward the manual contact opening and closing mechanism 12. The thus bent bimetal 86 urges, through the pushing piece 91, the upper driven portion 92*b* of the tripping link 92 to rotate clockwise, resulting in a quick opening of the contacts, as in the case of the foregoing short-circuit current.

In performing the test tripping of the contacts after the circuit breaker is assembled, the operator manually presses the test push-button from the exterior of the cover member 22 to push the driven arm portion 94*b* of the test tripping piece 94, the latter of which will then pivot about the pivot shaft 93 to cause the upper driven portion 92*b* to be rotated clockwise by the pressing portion 94*a*, whereby the same contact opening as in the case of the foregoing excess current can be performed.

Figure 8A:
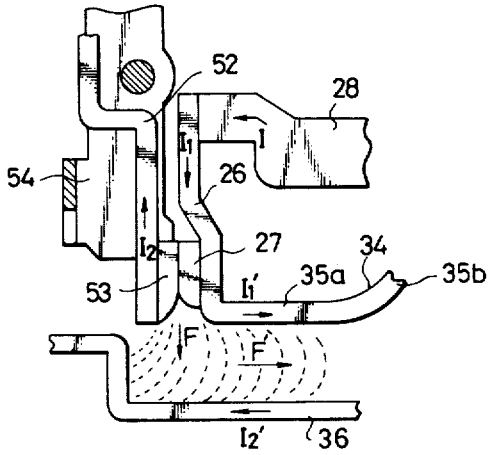
FIG. 8A is a schematic diagram showing relationships between the current, magnetic flux and electromagnetic force at the time when the contacts of the circuit breaker in accordance with the present invention are opened.
Figure 8B:
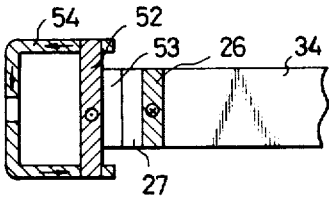
FIG. 8B is a schematic diagram showing how the magnetic fluxes are directed in members included in the contact section at the time of opening the contacts.

According to a remarkable feature of the present invention, as will be clear from the above descriptions and specifically when FIGS. 8A and 8B are referred to, the short-circuit current or an excess current separates the movable contactor 52 from the fixed contactor 25, upon which an electric current I will flow through the fixed contactor 26 in the direction shown by an arrow $I_1$ from the linkage frame 28 to the first arc running plate 34 and also through the movable contactor 53 in the direction shown by an arrow $I_2$ from the free end to the contact opening and closing mechanism 12. This will result in that the currents $I_1$ and $I_2$ generate magnetic fluxes which are repulsive to each other and thus produce a magnetic driving force shown by an arrow F in the direction from the contact opening and closing mechanism 12 to the second arc running plate 36. In this case, the movable contactor 52 embraced in the contactor frame 54 made of magnetic material, and this contactor frame 54 acts as a yoke to generate a strong magnetic force, whereby the magnetic driving force F is further increased.

Figure 1B:
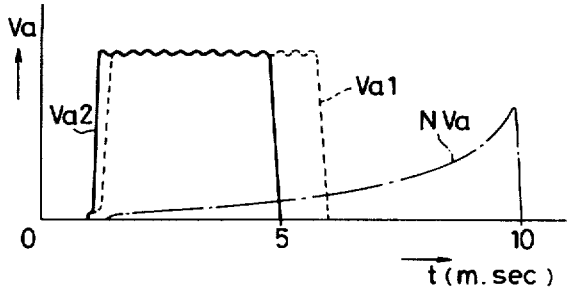
FIG. 1B is a waveform diagram of the arc voltages generated when the contacts are opened.
Figure 2:
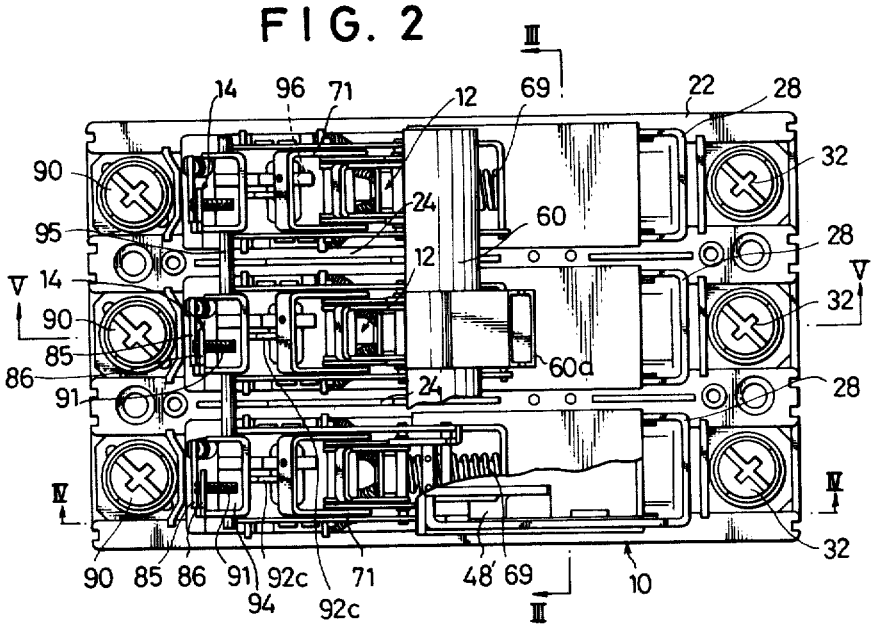
FIG. 2 is a plan view of a circuit breaker for use with three-phase A.C. power source in an embodiment of the present invention, with its cover member and certain parts removed.
Figure 3:
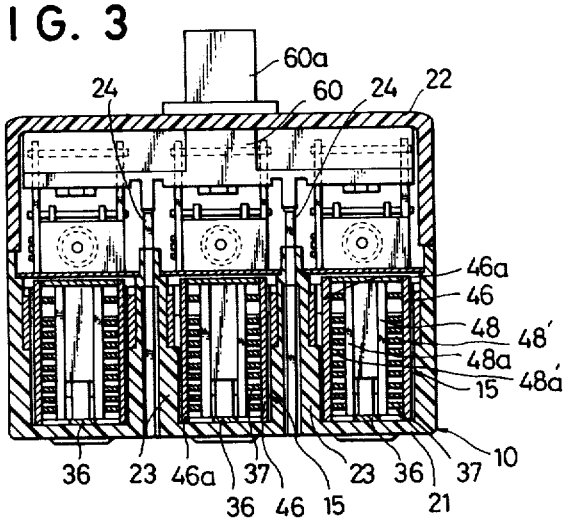
FIG. 3 is a cross sectional view of the circuit breaker of FIG. 2 taken along line III—III in FIG. 2, with the cover member mounted.
Figure 4:
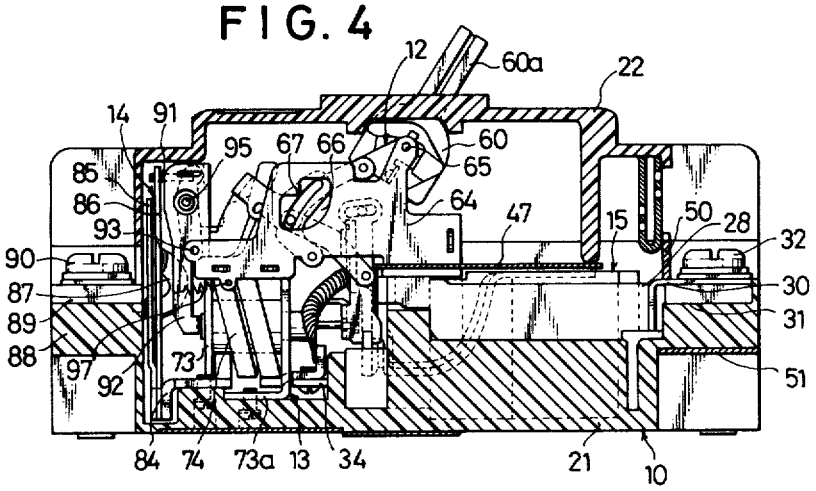
FIG. 4 is a cross sectional view of the circuit breaker of FIG. 2 taken along line IV—IV in FIG. 2, with the cover member mounted.

The arc generated upon the separation of the movable contact 53 from the fixed contact 27 will be driven by this strong magnetic driving force toward one end of the second arc running plate 36. The arc current caused to flow through the first and second arc running plates 34 and 36 is made to be opposite in the respective plates as shown by arrows $I_1'$ and $I_2'$ in FIG. 8A, which are substantially the same as extending directions of the fixed and movable contactors, whereby a further magnetic driving force F' is generated as directed from the lower portion of the contact section 11 toward the arc suppressing means 15. This magnetic driving force F' will drive the arc from the lower portion of the contact section 11 to the arc suppressing means 15. In this case, the magnetic driving force F' can be made larger by rendering the distance between the lower portion of the first arc running plate 34 and the second arc running plate 36 to be the minimum but to the extent of not causing any spatial short-circuit between the plates. Thereafter, the arc will expand between the intermediate and upper portions 35*b* and 35*c* of the first arc running plate 34 and the second arc running plate 36 to reach the deion grid assembly 37, where the expanded arc is divided into many small arcs in the respective gaps between the grids 38 to be thus cooled and suppressed. With the above arrangement, the contactor frame 54 acting as a yoke is attached to the movable contactor 52 and the distance between the lower portion 35*a* of the first arc running plate 34 and the second arc running plate 36 is selected to be the minimum so as to increase the magnetic driving force, whereby the transfer of arc from the contact section 11 to the arc suppressing means 15 can be extremely accelerated and such time required until the arc voltage reaches its maximum level or until the arc disappears as has been described earlier with reference to FIGS. 1A and 1B can be effectively shortened.

According to another feature of the present invention, the arc gas flowing paths 48' and 48*a'* are defined between the insulative side plate 46 or 46*a* and the supporting plate 48 or 48*a* in the arc suppressing means 15, so that a portion of the arc gas which has reached the arc suppressing means is circulated through the paths 48' and 48*a'* toward the contact section 11, the arc gas pressure can be balanced between the contact section 11 and the grid assembly 37, so as to allow the arc gas to return directly to the contact section 11 through the space between the first and second arc running plates 34 and 36, whereby any reduction in the arc current in the first and second arc running plates 34 and 36 can be prevented from occurring.

Further, as the first arc running plate 34 can be prevented from moving upward by means of the pressing plate 49, any unfavourable floating of the first arc running plate 34 due to the arc gas can be avoided and any variation in the distance between the lower portion 35*a* of the first arc running plate 34 and the second arc running plate 36 can be minimized.

What is claimed is:

1. A circuit breaker comprising a housing, a manual contact opening and closing mechanism including a handle extending from said housing and a link operatively coupled to said handle, said mechanism being made operative through the handle by locking a tripping member to the mechanism while being made inoperative by releasing said tripping member, a movable contactor having a movable contact and capable of being rocked by the manual contact opening and closing mechanism, a fixed contactor having a fixed contact with which said movable contact is engageable, means for resiliently biasing said movable contactor to be separated from said fixed contactor, an arc suppressing means including a deion grid assembly, a first arc running plate extending from the fixed contactor and a second arc running plate extending from a position adjacent both the fixed and movable contactors to a position adjacent a free end of said first arc running plate, said first arc running plate having a lower portion disposed parallel to said second arc running plate and in facing relationship therewith, said lower portion of said first arc running plate and said second arc running plate arranged to conduct arc currents in mutually opposite directions and being spaced apart sufficiently to prevent short-circuiting therebetween and close enough to generate therebetween a magnetic force which drives an arc toward said deion grid assembly, said first arc running plate further including an upper portion opposed to the second arc running plate in a wider spaced relation thereto and an intermediate portion extended diagonally between said lower and upper portions, said deion grid assembly being arranged in said wider space, and a tripping means for releasing said tripping member from the manual contact opening and closing mechanism so as to separate the movable contactor from the fixed contactor at least by a force of said biasing means in response to an excess current.

2. A circuit breaker as defined in claim 1, wherein said lower and upper portions of said first arc running plate are mutually parallel.

3. A circuit breaker comprising a housing, a manual contact opening and closing mechanism including a handle extending from said housing and a link operatively coupled to said handle, said mechanism being made operative through the handle by locking a tripping member to the mechanism while being made inoperative by releasing said tripping member, a movable contactor having a movable contact and capable of being rocked by the manual contact opening and closing mechanism, a fixed contactor having a fixed contact with which said movable contact is engageable, means for resiliently biasing said movable contactor to be separated from said fixed contactor, an arc suppressing means including a deion grid assembly, a first arc running plate extending from the fixed contactor and a second arc running plate extending from a position adjacent both the fixed and movable contactors to a position adjacent a free end of said first arc running plate, said first arc running plate having a lower portion located as opposed to said second arc running plate in a relatively narrow spaced relation thereto, an upper portion opposed to the second arc running plate in a wider spaced relation thereto, and an intermediate portion extended diagonally between said lower and upper portions, said deion grid assembly being arranged in said wider space, and a tripping means for releasing said tripping member from the manual contact opening and closing mechanism so as to separate the movable contactor from the fixed contactor at least by a force of said biasing means in response to an excess current, said fixed and movable contactors being provided with a sufficient length and arranged parallel to have a current flowed through them in opposite directions, and said movable contactor is held in an open end of a contactor frame made of a magnetic material in a U-shaped configuration as viewed from the top and having at least in a part substantially the same length as that of the movable contactor.

4. A circuit breaker comprising a housing, a manual contact opening and closing mechanism including a handle extending from said housing and a link operatively coupled to said handle, said mechanism being made operative through the handle by locking a tripping member to the mechanism while being made inoperative by releasing said tripping member, a movable contactor having a movable contact and capable of being rocked by the manual contact opening and closing mechanism, a fixed contactor having a fixed contact with which said movable contact is engageable, means for resiliently biasing said movable contactor to be separated from said fixed contactor, an arc suppressing means including a deion grid assembly, a first arc running plate extending from the fixed contactor and a second arc running plate extending from a position adjacent both the fixed and movable contactors to a position adjacent a free end of said first arc running plate, said first arc running plate having a lower portion located as opposed to said second arc running plate in a relatively narrow spaced relation thereto, an upper portion opposed to the second arc running plate in wider spaced relation thereto and an intermediate portion extended diagonally between said lower and upper portions, said deion grid assembly being arranged in said wider space, and a tripping means for releasing said tripping member from the manual contact opening and closing mechanism so as to separate the movable contactor from the fixed contactor at least by a force of said biasing means in response to an excess current, wherein gas flowing paths are formed on side portions of said arc suppressing means for circulating arc gas which has reached the arc suppressing means from said contactors.

5. A circuit breaker comprising a housing, a manual contact opening and closing mechanism including a handle extending from said housing and a link operatively coupled to said handle, said mechanism being made operative through the handle by locking a tripping member to the mechanism while being made inoperative by releasing said tripping member, a movable contactor having a movable contact and capable of being rocked by the manual contact opening and closing mechanism, a fixed contactor having a fixed contact with which said movable contact is engageable, means for resiliently biasing said movable contactor to be separated from said fixed contactor, an arc suppressing means including a deion grid assembly, a first arc running plate extending from the fixed contactor and a second arc running plate extending from a position adjacent both the fixed and movable contactors to a position adjacent a free end of said first arc running plate, said first arc running plate having a lower portion located as opposed to said second arc running plate in a relatively narrow spaced relation thereto, an upper portion opposed to the second arc running plate in a wider spaced relation thereto and an intermediate portion extended diagonally between said lower and upper portions, said deion grid assembly being arranged in said wider space, and a tripping means for releasing said tripping member from the manual contact opening and closing mechanism so as to separate the movable contactor from the fixed contactor at least by a force of said biasing means in response to an excess current, said arc suppressing means includes vibration restricting means having a contour corresponding to said lower and intermediate portions of said first arc running plate and fixed between a pair of opposing insulative plates holding the arc suppressing means, said vibration restricting means engaging the lower and intermediate portions of said first arc running plate to prevent vibrations of the latter.

* * * * *